US006467932B2

(12) United States Patent
Lin

(10) Patent No.: US 6,467,932 B2
(45) Date of Patent: Oct. 22, 2002

(54) STRUCTURE OF ARTISTIC TABLE LAMP

(76) Inventor: Mei-Lu Lin, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/738,930

(22) Filed: Dec. 14, 2000

(65) Prior Publication Data

US 2002/0075682 A1 Jun. 20, 2002

(51) Int. Cl.[7] ..... F21V 21/116

(52) U.S. Cl. ..... 362/249; 362/227; 362/392; 362/414; 362/431; 362/810

(58) Field of Search ..... 362/122, 124, 362/227, 234, 249, 250, 252, 392, 393, 806, 808, 810, 431, 414

(56) References Cited

U.S. PATENT DOCUMENTS

| | | | | | |
|---|---|---|---|---|---|
| 1,060,278 | A | * | 4/1913 | Nelson | 362/392 |
| 1,783,277 | A | * | 12/1930 | Block | 362/392 |
| 1,976,964 | A | * | 10/1934 | Propp | 362/392 |
| 2,053,139 | A | * | 9/1936 | Donovan et al. | 362/392 |
| 2,077,107 | A | * | 4/1937 | Grundman | 362/392 |
| 5,113,329 | A | * | 5/1992 | Lin | 362/249 |

* cited by examiner

*Primary Examiner*—Alan Cariaso

(57) ABSTRACT

A structure of artistic table lamp includes a lamp holder composed of a post and a plurality of branches of hollow interior each having a slit along the length, a lamp stand on the bottom of the post and a socket on the top of each of the branches for disposing a string of Christmas light therein for protecting the string of Christmas lights by a plurality of rail belts. It is characterized that this artistic table lamp can be made into a variety of shapes such as a sportsman.

3 Claims, 7 Drawing Sheets

STRUCTURE OF ARTISTIC TABLE LAMP

BACKGROUND OF THE INVENTION

The present invention relates to Christmas light and more particularly to a structure of artistic table lamp made in combination with a string of Christmas lights.

Conventional table lamp (as shown in FIG. 1) comprises a lamp holder 1 on a lamp base 2. The holder 1 has three branches each including a drip pan 3 on the top for burning the candles 4 on it. Because the burning candle 4 has a danger of catching fire, people tend to use an electric lamp instead of the candle 4. However, this lamp holder 1 is usually made of a solid structure which can not dispose an electrical wire to connect with an electric lamp.

SUMMARY OF THE PRESENT INVENTION

The present invention has a main object to provide a structure of artistic table lamp which can be combined with a string of Christmas lights.

Another object of the present invention is to provide a structure of artistic table lamp in which all the branches of the holders and the drip pans have a slit to facilitate disposal of the electric wires of a string of Christmas lights to dispose therein.

Another object of the present invention is to provide a structure of artistic table lamp in which has a plurality of rail belts inserted into the slits in order to protect the electric wire from breaking off the slits.

Further object of the present invention is to provide a structure of artistic table lamp which can be molded into variety of shapes.

The present invention will become more fully understood by reference to the following detailed description thereof when read in conjunction with the attached drawings.

DETAILED DESCRIPTION OF THE PREFERRED EMBODIMENT

Figure 1:
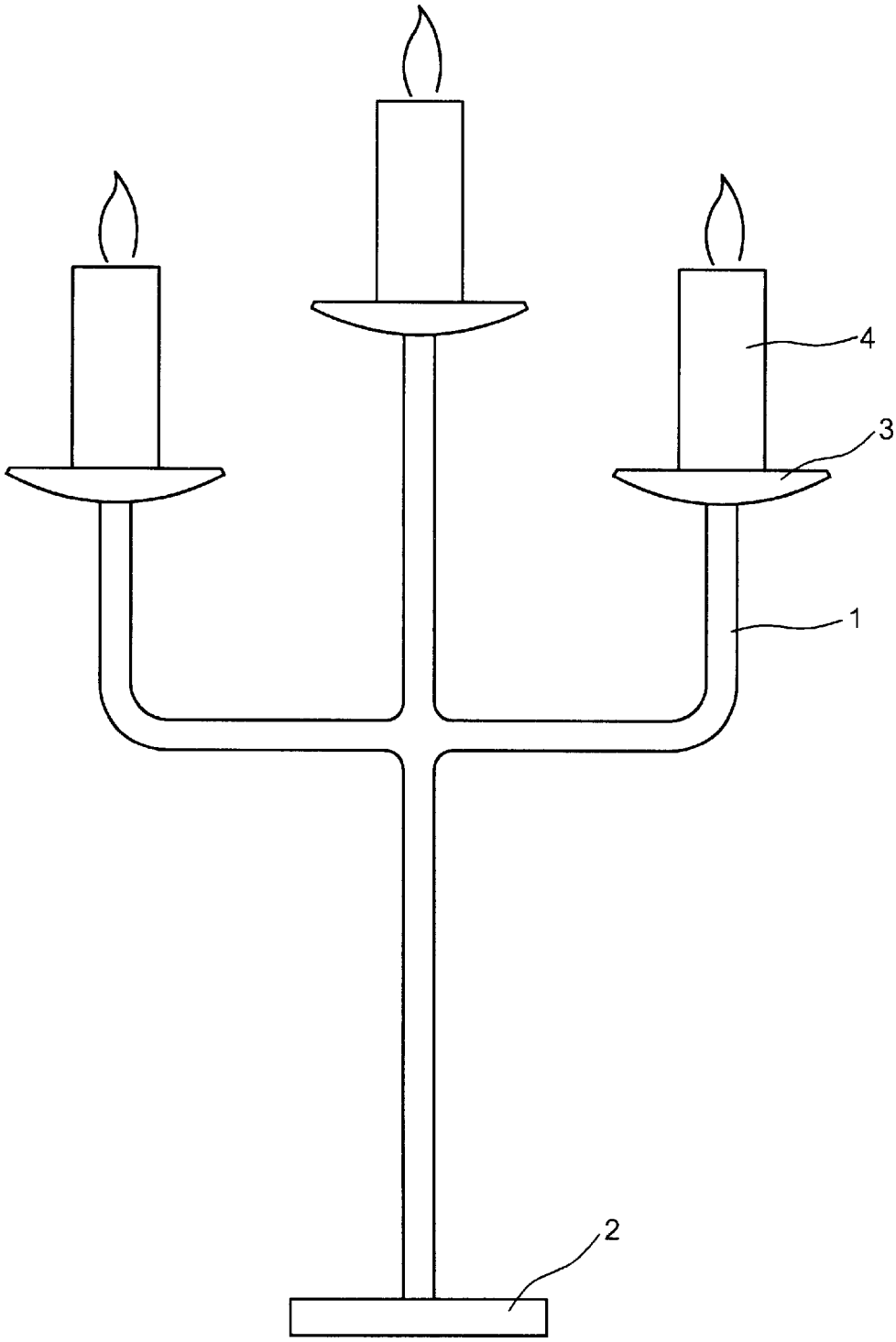
FIG.1 Prior Art
FIG. 1 is an elevational view to show a table lamp of a prior art.
Figure 2:
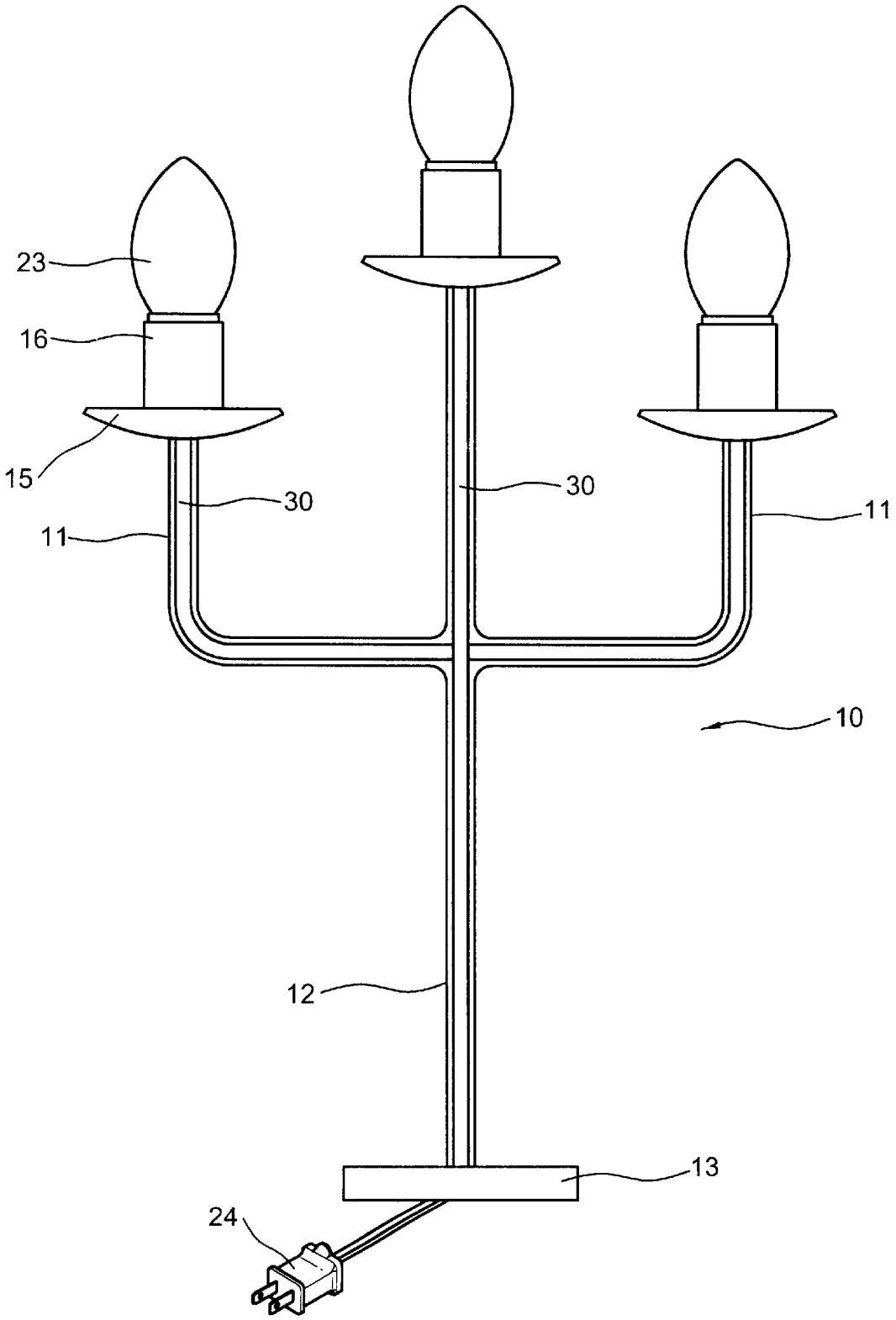
FIG. 2 is an elevational view to show an artistic table lamp of the preferred embodiment according to the present invention.
Figure 3:
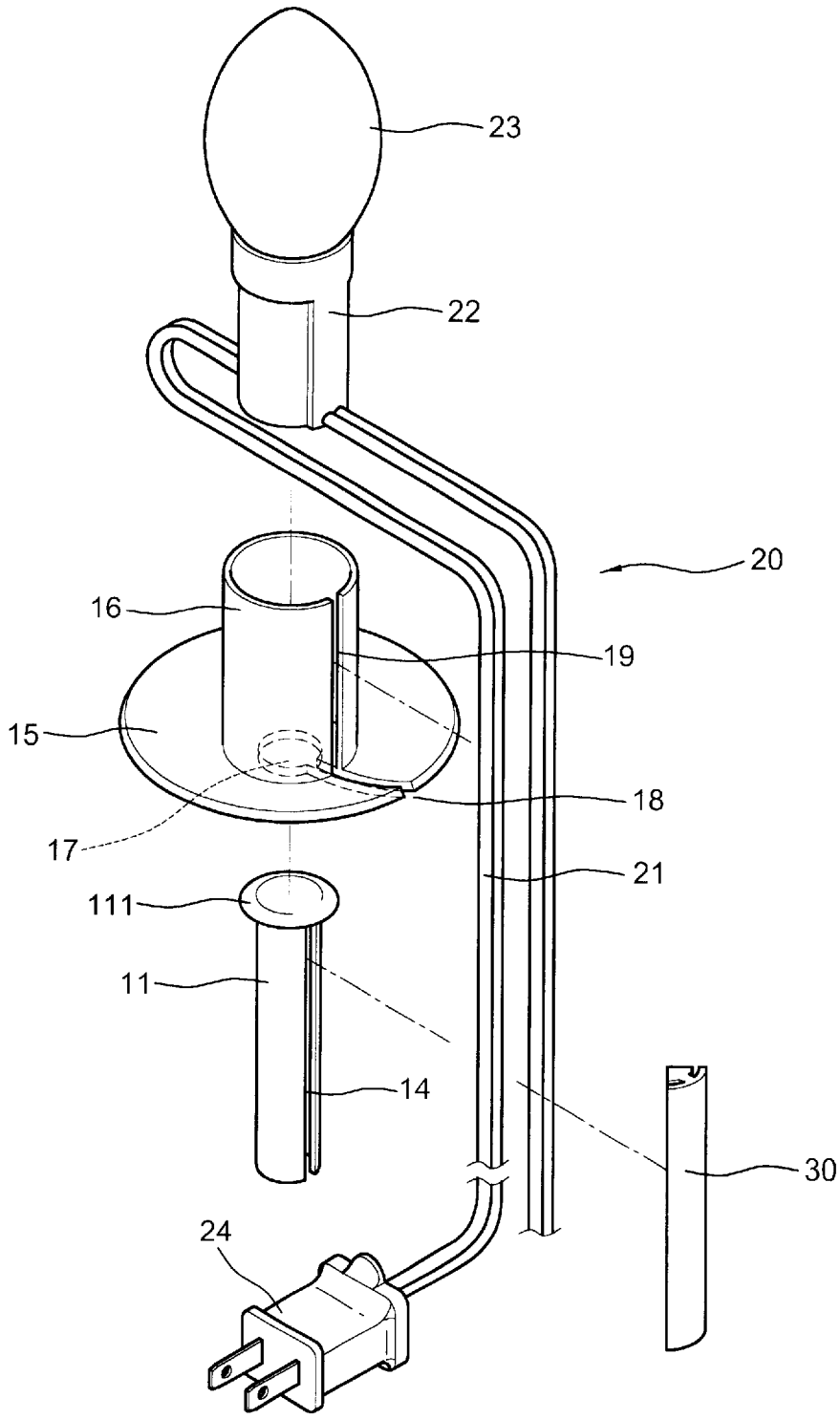
FIG. 3 is an exploded perspective view to show partially the lamp holder of the present invention.
Figure 4:
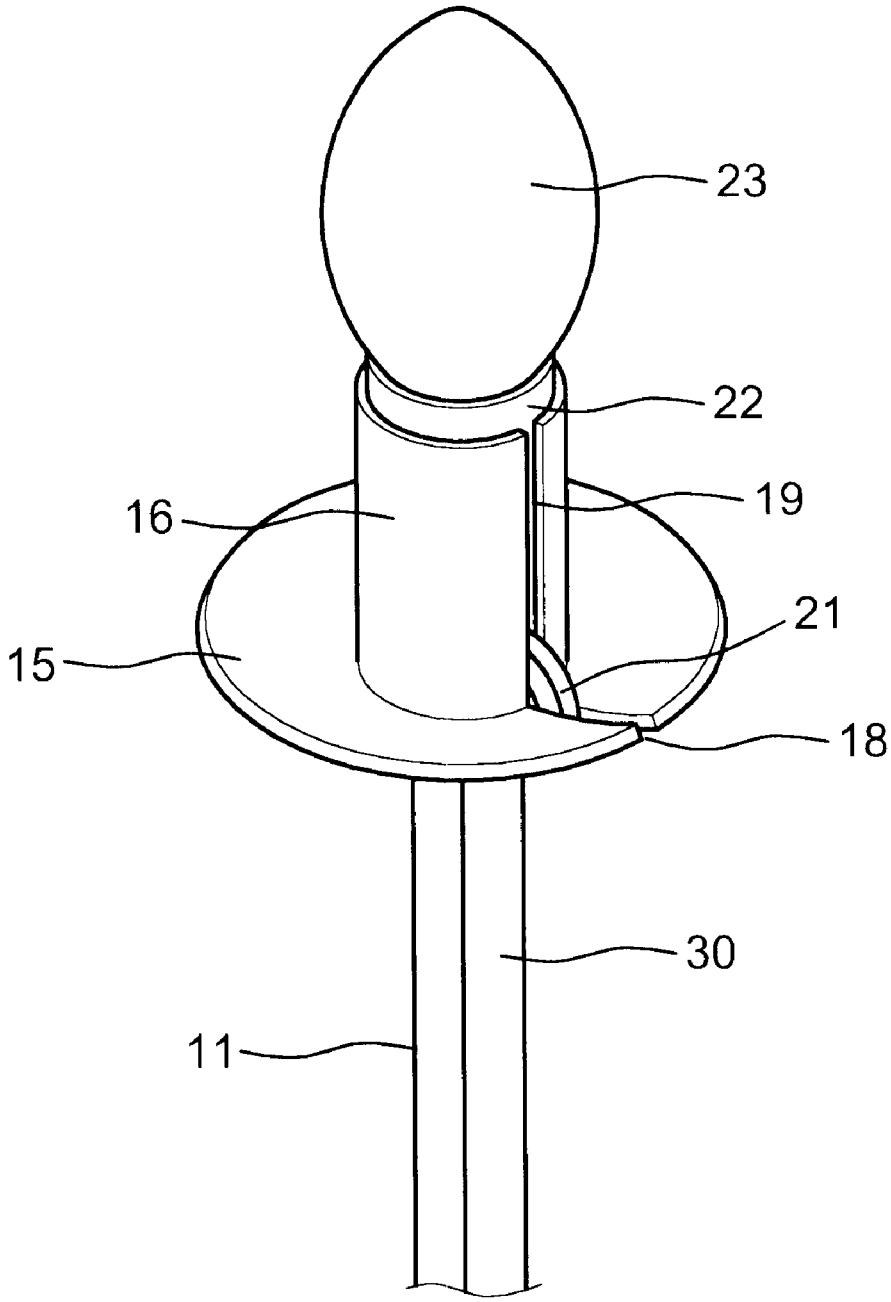
FIG. 4 is a perspective view to show the combination of FIG. 3.
Figure 5:
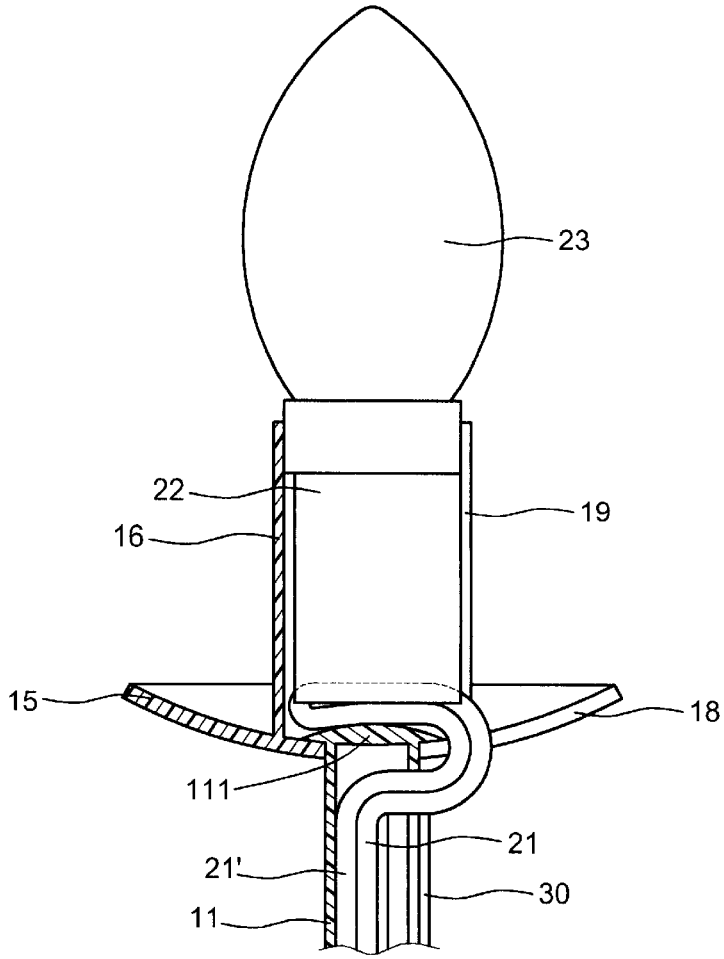
FIG. 5 is a sectional view to show the relationship between the lamp holder, the drip pan and the electric wire.
Figure 6:
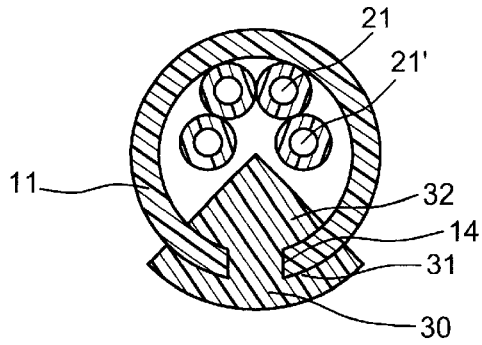
FIG. 6 is a sectional view to show the rail belt engaged with the slit.

With reference to FIGS. 2, 3 and 4 of the drawings, the structure of artistic table lamp of the present invention comprises generally a lamp holder 10 which is composed of a post 12 and a pair of branches 11, a lamp stand 13 on the bottom. Both the post 12 and the branches 11 are of hollow interior and each has a slit 14 axially formed in an outer periphery along the length thereof by which a string of Christmas lights 20 can enter into the post 12 and the branches 11. An annular flange 111 on the tops of the branches 11 and the post 12 pressingly insert each of the branches 11 and the post 12 into a central bore 17 of a drip pan 15 which has a radial slit 18 in one side communicating to the central bore 17. A socket 16 integrally projects upward from the top center of the drip pan 15 which also has an axial slit 19 in a peripheral wall along the length thereof. The axial slit 19 is communicating with the radial slit 18 of the drip pan 15. The socket 16 can receive a base 22 of a Christmas light which has a bulb 23 on the top of the base 22. After the electric wires 21 of the string of Christmas lights are inserted into the post 12 and the branches 11, each of the slits 14 is covered by a rail belt 30 of triangular shaped cross-section (as show in FIGS. 5 and 6). The rail belt 30 has a pair of longitudinal slots 31 engageable with the slits 14 and a stop member 32 for preventing the wires 21 from breaking off the slit 14. The string of Christmas light has also a plug 24 at lower end of the wires 21 under the lamp stand 13.

Figure 7:
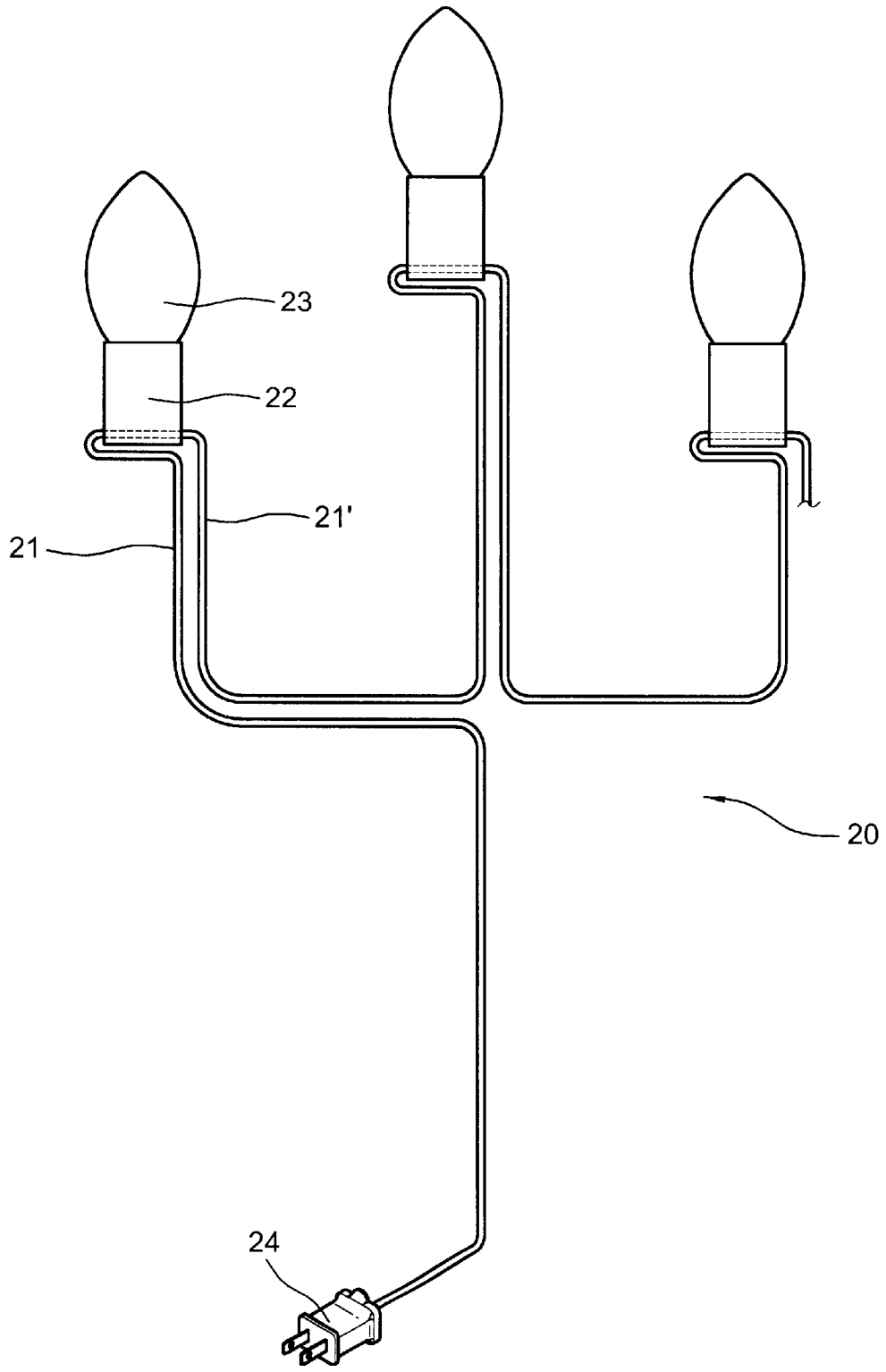
FIG. 7 is a plane view to show a string of Christmas lights combinable with the artistic table lamp.

Referring to FIG. 7. before the combination of the string of Christmas lights 20 with the table lamp 10, the length of the wires 21 and 21' must be precedingly decided. Then insert the wire 21 into the slit 14 of the post 12 and the branches 11 and engage the base 22 of the Christmas light into a first socket 16 and then insert the wire 21' into the same branch and the other branches 11 circuitously. After all the bases 22 of the Christmas lights 20 are engaged with the sockets 16, twist turn the wire 21' backward until it joins with the beginning point of the wire 21. Then connect the wires 21 and 21' to the plug 24 which will connect to an external power source.

Figure 8:
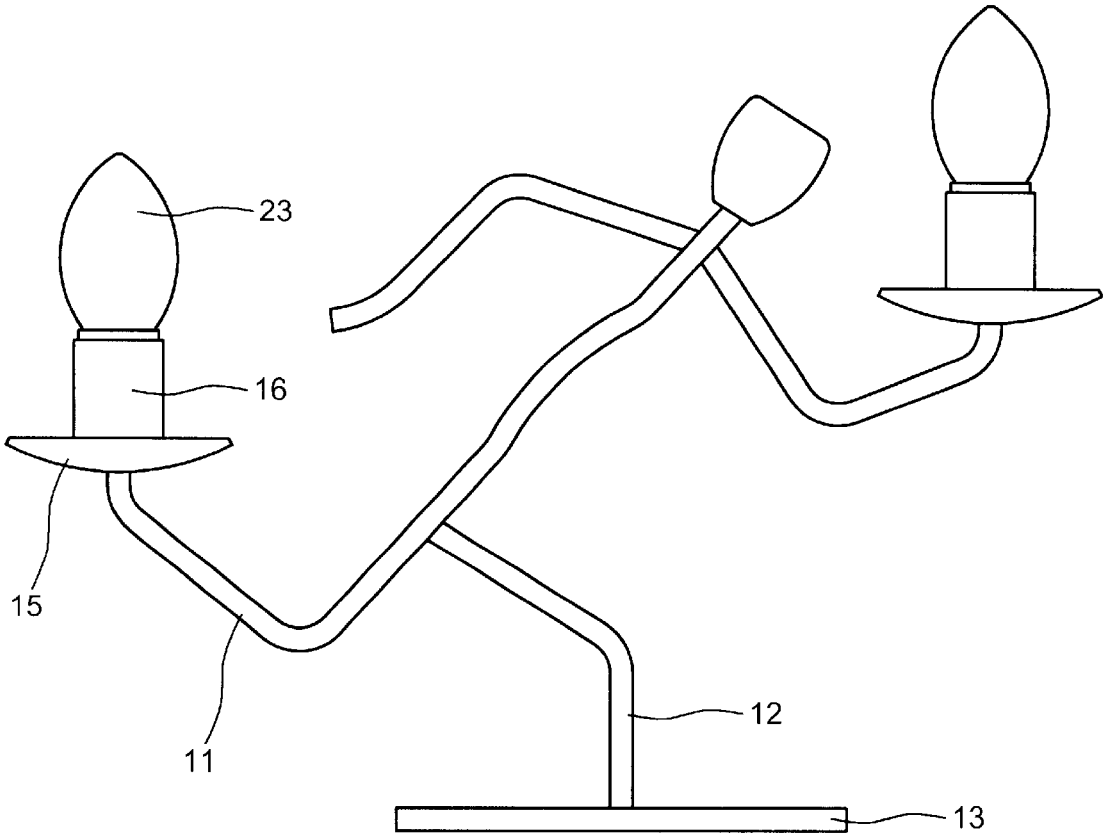
FIG. 8 is an elevational view to show another shape of the artistic table lamp.

FIG. 8, the artistic table lamp can be molded into a variety of shapes such as a sportsman.

Figure 9:
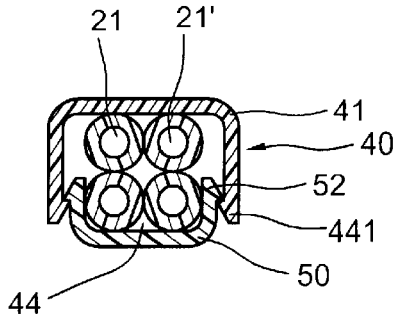
FIG. 9 is a sectional view of an alternate embodiment of the lamp holder.

Referring to FIG. 9, an alternate embodiment of a post and branches 40 is provided. The post on branches 40 has a hollow interior rectangular body 41 and a slit 44 which has a pair of inward hooks 441 at two ends. A rail belt 50 of U-shaped section made engageable with the slit 44 has a pair of outward hooks 52 made engageable with the inward hooks 441 of the post or branches 40. Because the rail belt 50 is elastic, the engagement of the hooks 441 of the slit 44 with hooks 52 of the rail belt 50 will be very secure to prevent the wires 21 and 21' from breaking off the slit 44.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A structure of artistic table lamp comprising:

a lamp holder which is composed of a hollow interior post and a plurality of hollow interior branches connected to each other, said branches each having an annular flange on top for pressingly engaging with a central bore of a drip pan each of which has a radial slit communicating with the central bore and a socket centrally projected upward from top of the drip pan to receive a lamp from a string of Christmas lights, an axial slit longitudinally formed in a peripheral wall of each of the branches and the post for inserting electric wires of the string of Christmas lights into the branches and the post, a lamp stand on bottom of the post and a plug connecting the electric wires under the lamp stand;

a plurality of flexible rail belts of triangular shaped cross-section covering the slits of the post and the branches respectively, said rail belt each having a pair of longitudinal slots engaged with edges of the slits to prevent the electric wires from breaking off the post and the branchs.

2. The structure as recited in claim 1 wherein said table lamp can be made into variety of shapes.

3. The structure as recited in claim 1 further has hollow interior rectangular lamp holder composed of a post and plurality of branchs each having a slit longitudinally formed in a wall along the length thereof, said slits each having a pair of inward hooks formed along two lateral edges thereof and a plurality of elastic rail belt of U-shaped section covering the slits each having a pair of outward hooks longitudinally formed along two edges made engageable with the inward hooks of the slits.

* * * * *